United States Patent [19]

Sabo

[11] 4,179,160

[45] Dec. 18, 1979

[54] MINE LIFE LINE SYSTEM

[76] Inventor: Robert C. Sabo, Rte. 2, Box 159-2, Fairmount, W. Va. 26554

[21] Appl. No.: 836,329

[22] Filed: Sep. 26, 1977

[51] Int. Cl.[2] ..... E21F 11/00; E04H 17/04; E04H 17/20; E06C 9/00

[52] U.S. Cl. ..... 299/12; 182/230; 211/86; 256/46

[58] Field of Search ..... 182/230, 190, 2, 3; 52/105; 299/12; 403/108; 211/86; 248/353, 356, 74 R, 74; 256/32, 46; 24/114.5; 244/118

[56] References Cited

U.S. PATENT DOCUMENTS

| | | | |
|---|---|---|---|
| 293,009 | 2/1884 | Griffith | 248/74. R X |
| 326,616 | 9/1885 | Woodbury et al. | 182/190 |
| 578,032 | 3/1897 | Smith | 256/46 |
| 1,031,360 | 7/1912 | Miller | 24/114.5 |
| 3,408,025 | 10/1968 | Davis | 182/230 X |
| 3,914,825 | 10/1975 | Reynolds | 24/114.5 X |

FOREIGN PATENT DOCUMENTS

| | | | |
|---|---|---|---|
| 164861 | 11/1953 | Australia | 211/86 |

OTHER PUBLICATIONS

Code of West Virginia, 1977 Cumulative Supplement, Chapter 22, Article 2 Section 22-2-60.

*Primary Examiner*—Louis Rimrodt
*Attorney, Agent, or Firm*—Robert D. Yeager

[57] ABSTRACT

A mine life line system utilizing a life line having direction indicating means for indicating, when touched, the direction towards the outside of the mine. The direction indicating means is formed so that as the miner walks towards the outside of the mine, running his hand along the life line, his hand meets little resistance if he is going in the proper direction. The direction indicating means can be an enlargement which is formed integral with or attached to the life line. The enlargement can be formed with a gradual slope on one side along which a hand can easily move when traveling in the right direction, and a stop or abrupt slope, which tends to stop the hand, when traveling in the wrong direction. The direction indicating means and/or the life line can be formed from luminesce or reflective material. A spring loaded reusable support is provided for supporting the life line.

6 Claims, 7 Drawing Figures

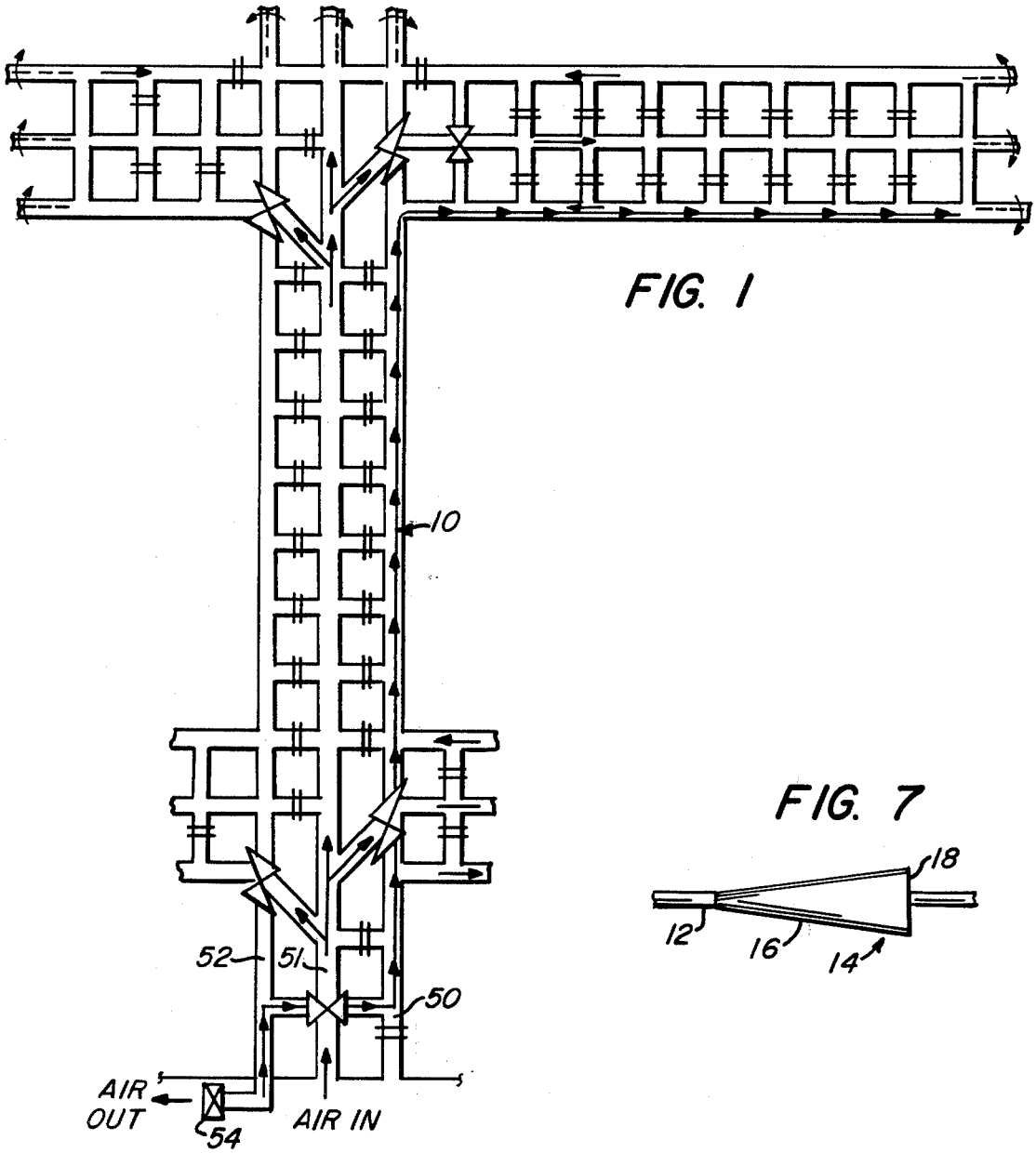
FIG. 1
FIG. 7
FIG. 2
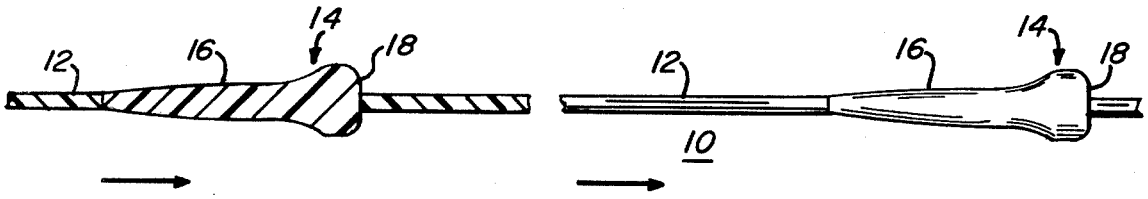

MINE LIFE LINE SYSTEM

BACKGROUND OF THE INVENTION

1. Field of the Invention

This invention relates to safety equipment for use in a mine and more particularly to a mine life line system.

2. Description of the Prior Art

In mining a seam of coal normally at least three shafts are started into the seam. These spaced apart shafts are continued as coal is extracted from the seam. The spaced apart shafts are interconnected by cross passages at regular intervals. Even if the mining direction changes the three shafts are maintained. The three shafts are utilized for moving men and material into the mine and for removing coal. Air is drawn into the mine and through the interconnected shafts. At least one of the shafts is a return air shaft. Air which is drawn into the mine is returned to the outside through this return air shaft. The return air shaft is normally designated an escape way and is used only by mine personnel. The shafts can extend a great distance into the seam, often several miles, and the shafts can often have several changes of direction. To facilitate the escape of miners in the event of an accident, it is West Virginia Law to have a life line installed in the escape way, which a miner can follow by touch to the outside of the mine. A problem with a simple life line, however, is that when an accident occurs, a miner may become very disoriented and be uncertain of the direction in which to follow the life line.

In some areas of the United States, the use of life lines within a mine is presently required. For example, in West Virginia it is required that two-way communication and life line or its equivalent shall be provided from the fresh air base to all rescue or recovery teams. The Underground Coal Mine Safety Laws for the state of West Virginia presently provides: "On or after the first day of April, one thousand nine hundred seventy-eight, each operator shall provide lifeline cords with reflective material at twenty-five foot intervals, from the last open crosscut to the surface along a designated escapeway ventilated by return air: Provided, that in case of a shaft mine such lifeline cords shall extend from the last open crosscut to the bottom of the designated escape shaft. Such lifeline cord shall be of durable construction sufficient to allow miners to see and to use effectively to guide themselves out of the mine in the event of an emergency."

SUMMARY OF THE INVENTION

This invention teaches a direction indicating life line which a miner can follow by hand towards the outside of the mine. The life line can be followed without light and provides an indication that a miner is traveling in the proper direction towards the outside of a mine. The life line is formed with spaced apart enlargements which provides little resistance when a hand is slid over them in one direction and a much larger resistance when a hand is slid into them in the other direction. The enlargements can be generally cone shaped to provide a gradual slope from the life line to the enlarged diameter portion in one direction and an abrupt stop from the life line to the enlarged diameter portion in the other direction. During use a miner slides his hand along the life line when walking out of the mine. If the miner is walking in the proper direction, his hand will slide up the gradual slope of the enlargement and easily pass there-over, however, if he is walking in the wrong direction, his hand will meet a horizontal stop or steep-sloping portion of the enlargement and will be retarded or stopped. When the miner's hand hits the stop, he knows he is going in the wrong direction and can turn around and follow the life line towards the outside.

The life line and the integral direction indicating means can be formed from a luminesce or reflective material. The direction indicating enlargements can be placed at uniformed distance along the life line. The life line can be formed from a relatively strong resilient material so that it will not be easily damaged or broken. The direction indicating life line should be formed from a strong resilient material such as nylon or polytetrafloroethylene (TEFLON TM) or the like. The enlargements can be formed integral with the life line or as separate attachments thereto. The life line and the enlargements can be formed from a wide variety of suitable materials.

Spring loaded reusable supports are provided for holding the direction out indicating life line. During installation the spring loaded reusable supports are depressed and aligned vertically; they are then permitted to expand to engage the mine's floor and roof. The spring loaded reusable supports are formed from two tubular members one of which extends partially within the other. A spring disposed inside the larger tubular member is utilized for biasing the two tubular members apart, to an extended position. A spear or wedge type tip is provided on the free ends of the tubular members for engaging the mine roof and the mine floor. These sharp tips, when in use, limit rotation of the supports. Luminesce or reflective markings can be provided on the spring loaded reusable supports. The luminesce markings can be bands formed around the various tubes. Since the supports are spring loaded, if the top of the mine sags or if the floor of the mine rises, the support will collapse as needed to take up this difference without effecting its ability to properly support the life line. The spring can provide a force of 50 to 200 lbs. for securely holding the supports in place. The hook which holds the life line is attached to the longer tubular member for movement therewith.

The life line holding member consists of a portion which extends horizontally from the tubular member and and upward vertically extending portion. A hook for engaging the one way out life line is formed at the top of the vertical portion. The hook can include a member which when rotated locks the life line in place. The life line can be knotted at the hook so that if one section of the life line becomes broken or damaged, the other sections will remain intact.

It is an object of this invention to teach a life line for use in a mine wherein the direction towards the outside can easily be ascertained by a miner running his hand along the life line.

It is a further object of this invention to teach a life line system for use in a mine utilizing spring loaded reusable supports for supporting the life line.

It is yet a further object of this invention to teach a luminesce life line for use in a mine in conjunction with spring loaded reusable supports formed with luminesce markings.

BRIEF DESCRIPTION OF THE DRAWINGS

For better understanding of this invention, reference may be had to the preferred embodiments exemplary of the invention shown in the accompanying drawings in which:

FIG. 1 is a schematic view of a hypothetical coal mine wherein the life line system could be used;

FIG. 2 is a view partially in section of a direction indicating life line according the invention;

DESCRIPTION OF THE PREFERRED EMBODIMENTS

Figure 5:
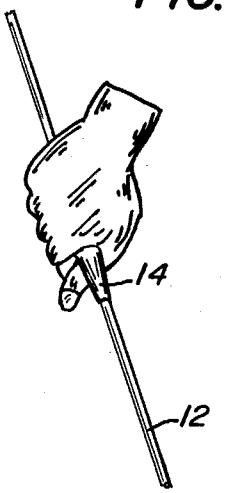
FIG. 5 is a view of the life line support showing a miner's hand engaging the stop side of the direction indicating enlargement.

Referring now to FIG. 1 of the drawings, there is shown a mine layout wherein a life line could be used. The mine includes three shafts 50, 51, and 52. Fans 54 are provided to suck air through the mine. Proper partitions are provided in the mine so that air is drawn in through shaft 51 and exhausted through shaft 50. Numerous cross connections are formed between shafts 50, 51, and 52 for removing coal. Equipment and mining machinery is utilized in shafts 51, 52, while shaft 50 is normally maintained only for use by personnel. Shaft 50 is designated an escape way for personnel and is not for use of equipment. The disclosed direction indicating life line 10, shown in FIG. 2, is strung in shaft 50 so a miner can follow it to the outside.

Direction indicating life line 10 includes a line portion 12 and direction indicating enlargements 14. Enlargements 14 are formed at intervals along line 12. One side 16 of enlargement 14 is formed with a gradual slope to the life line 12 while the other side 18 of enlargement 14 is formed with an abrupt slope or stop. During use the one way life line 10 is loosely held by miners as they walk out of the mine during an emergency. When a miner is moving in the proper direction towards the outside of the mine, his hand meets with little resistance as it slides over to the gradual sloping portion 16. The miner thereby knows he is going in the proper direction. As often happens in an emergency, a miner may get disoriented and turn in the wrong direction, his hand will then meet with resistance as it contacts the steep horizontal portion 18 of the direction indicator 14. This steep portion 18 will tend to stop the miner's hand when engaged. When this happens, the miner knows he is traveling the wrong way and can change directions.

As shown in FIG. 5, when a miner's hand hits the stop side 18 of the enlargement 14, his hand will be stopped. The direction indicators 14 are placed at a uniformed distance along line 10, such as 20 feet, and when a person's hand is stopped by the steep sloping portion 18, he will realize that he is going in the wrong direction and turn around. It is critical that a person follow the life line in the right direction since he may have a limited time to get out of the mine. Miners are given self rescuers which are breathing apparatus which permits them to breath in a hazardous atmosphere. The breathing apparatus has a limited use time, such as 60 minutes, and if the miner does not exit the mine in this time, he may be injured or killed.

Life line 10 can be formed from a variety of materials, but is preferably formed from a strong, flexible material such as nylon or polytetrafloroethylene (TEFLON TM). Life line 10 can be luminesce or reflective. Life line 10 should be formed from a material which is tough and resilient.

Figure 3:
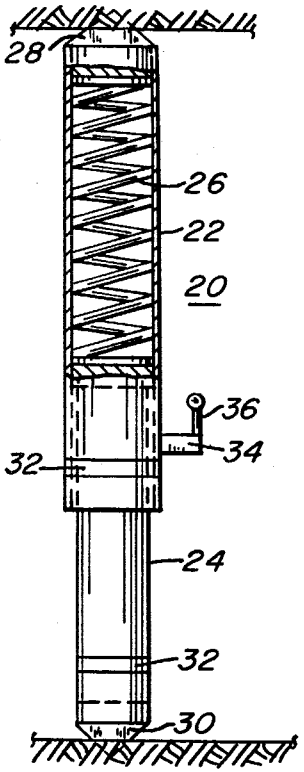
FIG. 3 is a view partially in section of a spring loaded support for the life line.
Figure 4:
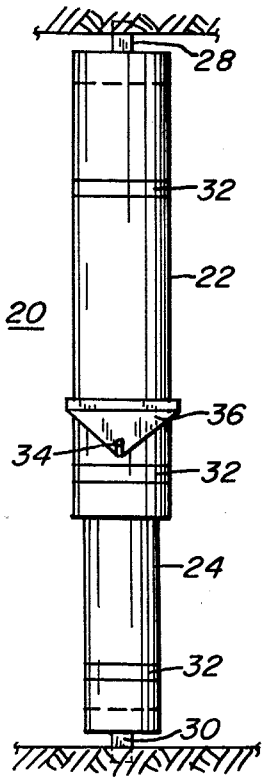
FIG. 4 is a side view of the spring loaded reusable support shown in FIG. 3.

Life line 10 is formed as a continuous line which can be wound on a spool. Life line 10 is supported at intervals by support posts. Preferrably, a spring loaded reusable support post 20, as shown in FIGS. 3 and 4, is utilized. The reusable spring loaded support post 20 comprises a top tubular member 22 and a smaller diameter tubular member 24 which partially extends within tubular member 22. Spring loaded reusable post 20 is movable between a compressed position and an extended position. Spring member 26 is disposed within tubular member 22 to bias tubular member 20 to the extended position. That is, spring 26 tends to bias tubular member 22 out of tubular member 24. A pointed wedge or spear type tip 28 is formed at the free end of tubular member 22 and a similar spear type tip 30 is formed at free end of tubular member 24. Internal spring 26 provides a force of 50 to 200 lbs for forcing support 20 to the extended position. The spring loaded reusable support can be used for various height mines. The spring loaded support is installed by placing the bottom on the mine floor and pulling the top down until support 20 is positioned vertically. The top 22 is then released and the spring 26 forces support 20 to extend and be securely held in place. If the roof gets heavy or the bottom heaves, the spring will allow the support 20 to collapse as needed so as not to damage its ability to hold the life line.

When the spring loaded support 20 is installed, the points 28 and 30 dig into the mine roof and floor respectively, and prevent the spring loaded support 20 from turning. The spring loaded supports 20 are fairly light weight so that the person installing the life line 10 can carry several supports 20 to install as he proceeds. Spring loaded supports 20 are very much superior to fixed length posts for use in a mine. Luminesce markings 32 are provided on spring loaded supports 20. If desired, markings 32 can be reflective.

The direction indicating life line is supported from a bracket extending from a tubular member 22. The support bracket includes a portion 34 extending outward from tubular member 22 and a vertical portion 36 extending upward from portion 34. The life line is supported at the top of the vertical member 36. Member 36 is constructed so that a miner's hand can easily open and slide around as he is following the life line 10 from the mine. A hook is positioned on the top of vertical portion 36 for holding line 10. The hook can be formed with a rotatable member which locks line 10 from being pulled out. Knots can be formed near the hook so if the line 10 between a pair of supports 20 is cut or broken, the rest of the line will remain in place.

Figure 6:
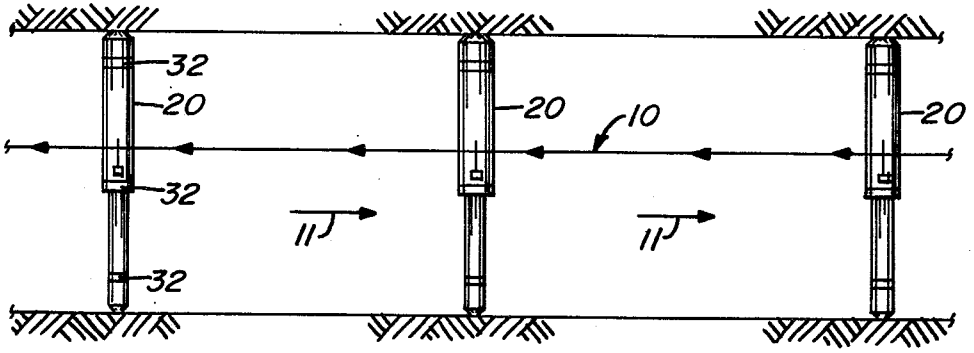
FIG. 6 is a view showing the life line extending between several spring loaded reusable supports; and, FIG. 7 is a side of another embodiment of a direction indicating life line.

FIG. 6 shows the life line 10 installed in a mine. Arrows 11 indicate the direction a miner would follow the line to the outside. It can be seen that the disclosed direction indicating life line provides a positive indication that a miner is traveling in the right direction during an emergency mine exit. The luminesce markings 32 make the life line 10 easy to locate. The disclosed life line system requires little effort to install and maintain, and it can be adapted for any coal seam height.

What is claimed is:

1. A life line system for use in the designated escape way of a mine comprising:

a spring loaded support compressable between a maximum extended length and a minimum compressed length;

a line holder supported from said spring loaded support;

a life line supported between a plurality of said spring loaded supports and extending along said designated escape way; and, a plurality of enlargements formed on said life line, each enlargement having a gradual slope to said line on one side providing little resistance when a hand is slid along said line in a direction along said designated escape way and having an abrupt slope to said line on the other side providing a substantially higher resistance when a hand is slid along said life line in a direction opposite said designated escape way.

2. A life line support system as claimed in claim 1 wherein said spring loaded support comprises:

a first tubular member;

a second tubular member disposed partially within said first tubular member; and, a spring disposed within said first tubular member to bias said first tubular member and said second tubular to the extended length.

3. A life line system as claimed in claim 2 comprising:

a spear type tip formed on the free end of said first tubular member; a spear type tip formed on the free end of said second tubular member on the free end of said second tubular member;

said spear tips engage the mine floor and mine roof when said spring loaded support is installed to prevent rotation of said spring loaded support.

4. A life line system as claimed in claim 3 comprising:

a plurality of luminesce strips attached around said first tubular member and said second tubular member.

5. A life line system as claimed in claim 3 comprising:

a plurality of reflective pieces attached to said first tubular member and said second tubular member.

6. A life line system as claimed in claim 1 wherein:

said life line and said enlargements are luminesce.

* * * * *